United States Patent [19]

Wolff

[11] 4,415,091

[45] Nov. 15, 1983

[54] ACCESSORIES FOR MOVABLE PARTITION SYSTEMS

[75] Inventor: Douglas F. Wolff, Marshall, Mich.

[73] Assignee: Wolff Wire Corporation, Ludington, Mich.

[21] Appl. No.: 269,417

[22] Filed: Jun. 1, 1981

[51] Int. Cl.[3] ..... A47F 7/00

[52] U.S. Cl. ..... 211/50; 211/88; 211/103; 211/106; 211/126; 248/220.2; 248/225.2

[58] Field of Search ..... 211/86, 87, 88, 126, 211/193, 106, 208, 191, 187, 192, 181, 103, 50; 248/222.1, 224.1, 220.3, 225.2, 220.2, 302, 303; 52/36, 643, 650; 108/134, 152, 30, 29

[56] References Cited

U.S. PATENT DOCUMENTS

| | | | |
|---|---|---|---|
| 1,495,189 | 5/1924 | Mack | 248/224.1 X |
| 2,210,235 | 8/1940 | Filbert | 248/224.1 |
| 3,115,107 | 12/1963 | Glenny | 211/106 X |
| 3,183,862 | 5/1965 | Melvin | 108/144 |
| 3,394,507 | 7/1968 | Doke | 211/103 X |
| 3,482,705 | 12/1969 | Bushey | 211/88 X |
| 3,915,097 | 10/1975 | Young, Jr. | 211/187 X |
| 4,133,433 | 1/1979 | Wolf | 211/192 |
| 4,151,917 | 5/1979 | Pugh | 211/187 X |

*Primary Examiner*—J. Franklin Foss
*Assistant Examiner*—David L. Talbott
*Attorney, Agent, or Firm*—Price, Heneveld et al.

[57] ABSTRACT

The invention provides a means for mounting accessories on space divider walls assembled from modular panels each of which has slotted support elements. The invention includes a beam which is anchored to the panel by engagement with the support elements. The beam has a plurality of pockets and the accessory units are equipped with hooks which detachably seat in the pockets.

14 Claims, 17 Drawing Figures

ACCESSORIES FOR MOVABLE PARTITION SYSTEMS

FIELD OF THE INVENTION

This invention relates to accessories for utilization with the unit panel type of office space dividers. The invention relates to a means by which certain types of accessory items such as magazine, book and paper racks, and similar storage facilities and work support units can be suspended from the panel structure.

BACKGROUND OF THE INVENTION

The concept of providing large, open work areas which are then subdivided into individual work areas by means of movable and rearrangeable partitions has become popular in recent years. The panels used to subdivide the area and form the separation walls are normally manufactured in a variety of modular widths, such as 12, 18, 24, 30, 36, 40, 48 or 60 inches. A number of manufacturers of these panels have entered the market utilizing different modular widths. Further, these panels are normally provided at each edge with means for detachably hanging a variety of accessory items, such as storage bins, shelving, work surfaces, bulletin boards and racks for storing or organizing various work materials such as paper. These accessories are supported by brackets designed to detachably engage and lock to slotted standards at the vertical edges of the panels.

It is common in this type of structure to provide a shelf with various subdivisions so that its top surface is divided into compartments to maintain order and organization of the materials placed on the shelf. For the purpose of organizing and storing various types of paper materials, the industry has developed baskets and work trays designed to be suspended beneath the shelves. Normally, the suspension mechanism for these devices is rigidly fixed to the shelf as by screws, thus, in effect, freezing the position of the basket or tray lengthwise of the shelf. Also in many cases the supports for a tray are not necessarily interchangeable with the supports for a storage rack. This invention is designed to eliminate the shortcomings of this type of construction and to provide a new, less expensive and more flexible approach to providing support for these various types of work material organizers.

BRIEF DESCRIPTION OF THE INVENTION

The invention provides a simple beam structure having brackets at each end to permit it to be detachably anchored to the vertical standards of the panels of the space divider system. The beams are designed to be of various lengths to adapt them to the modular widths of the panels of the various space divider wall manufacturers. The beam is designed to be rigid and to provide a plurality of identical pockets arranged in tandem. These pockets open through the top of the beam and extend at least the full height of the beam. The article supporting racks used with the beam each have at one end at least one hook structure having a depending leg of a shape and size to snugly seat in one of the pockets. The interfit between the hook and pocket is such as to eliminate rocking motion of the rack either lengthwise or laterally of the beam. Preferably, the leg of the hook is so spaced from the end of the rack that when the hook is seated in one of the pockets, the adjacent end wall of the rack seats against the outer surface of the beam, thus supporting the rack in cantilever fashion from the beam. The position of the rack lengthwise of the beam can be adjusted simply by lifting the hook out of one pocket and reseating it in another pocket. In a preferred construction, the various rack structures may be designed to have such a hook on either end, permitting it to be used facing either left or right and eliminating the necessity for separate tooling of left and right hand parts.

DESCRIPTION OF THE PREFERRED EMBODIMENT

Figure 1:
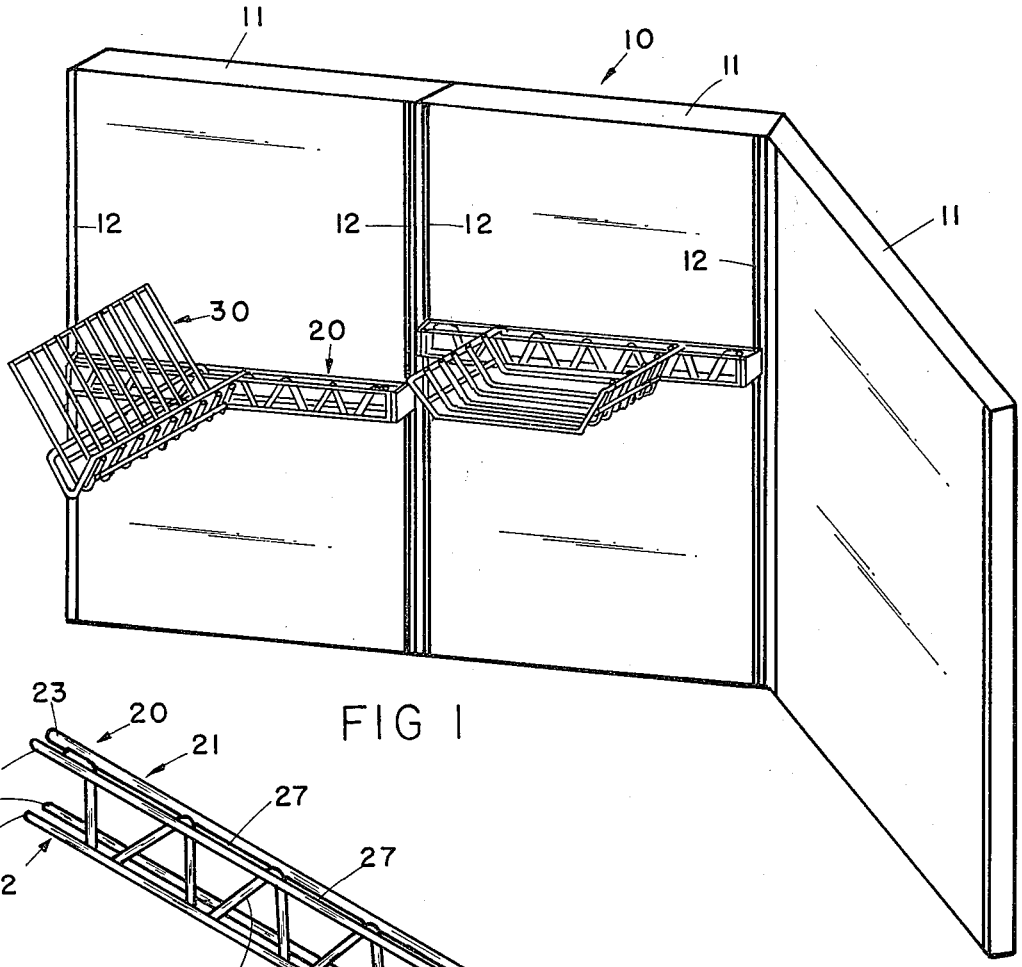
FIG. 1 is an oblique view of a portion of a panel wall illustrating the invention installed thereon.
Figure 2:
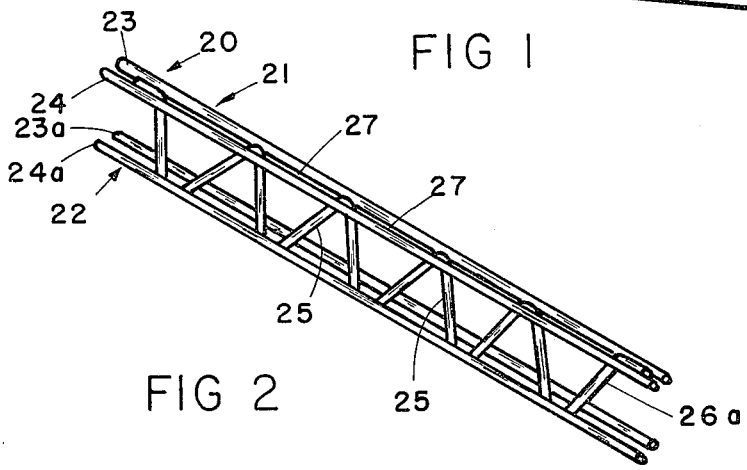
FIG. 2 is an oblique view of one of the beams of this invention before attachment of the end brackets.
Figure 8:
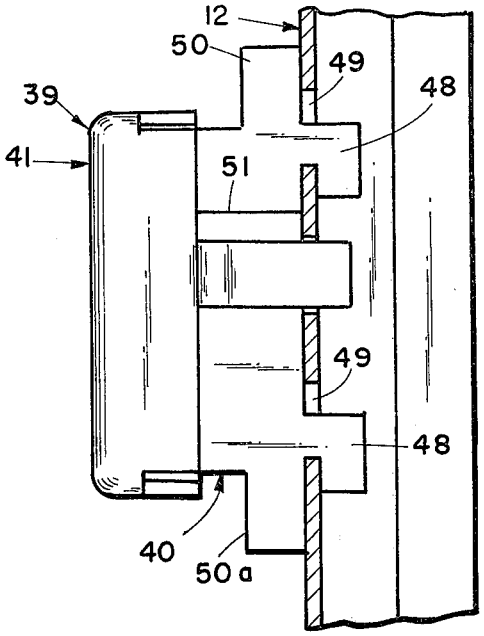
FIG. 8 is a fragmentary, sectional view of a conventional, slotted standard illustrating the end bracket of one of the beams secured in place.

The numeral 10 indicates a portion of a space divider panel structure illustrating three, individual panels 11 which have been locked together to form a wall unit. The opposite vertical ends of each of the panels are provided with a slotted standard 12 of conventional construction (FIGS. 1 and 8). The standard normally consists of a steel member having a plurality of vertical slots at one-inch spacing (FIG. 8). The standards 12 provide the means by which various accessories such as shelving, storage cabinets, work surfaces and the like can be detachably hooked to and supported from the panels 11. This is conventional practice in this type of movable panel or partition type space divider construction. The width of the panels 11 varies from one manufacturer to another and each particular manufacturer normally manufactures panels in several modular widths.

The invention utilizes a beam. The beam 20 consists of inner and outer side members 21 and 22. The inner side member 21 has upper and lower rods 23 and 23*a* and the outer side member 22 has upper and lower rods 24 and 24*a*. The side members are spaced apart by intermediate members 25. While the inner and outer members 21 and 22 could be panels of plate-like material or endless, elongated loops (see FIG. 17), to obtain the most economical and the lightest construction consonant with adequate strength, each of these members consists of a length of steel rod of a diameter such that when the entire beam is welded together, it will both withstand the vertical loads imposed on it and resist twisting of the entire beam due to the torsional loads applied by one or more of the hereinafter described racks. For example, ¼-inch diameter steel rod has been found to be satisfactory for manufacture of a beam of 30 inches in length and approximately 2 inches in height. The overall height of the beam must be adequate to stabilize the racks. This will appear more fully subsequently.

The intermediate members 25 are fabricated from the same material as the rods 23, 23*a*, 24 and 24*a*. The rod material is bent into V-shaped segments of identical size. These segments are inverted with their apices seated between the upper, inner and outer rods 23 and 24 and their ends seated between the lower, inner and outer rods 23*a* and 24*a*. The tops of the apices are flush with the tops of the upper rods of the side members. The lower end of adjacent segments are spaced apart to provide a gap opening through the bottom of each of the pockets 27. The pockets 27 are of identical size in each beam. At each end of the beam 20, a terminal segment 26*a* is provided which has one leg so inclined that it provides one side of a pocket 27 and a second leg extending horizontally between the upper, inner and outer rods of the side members.

The intermediate members 26 and 26*a* are welded to the upper and lower rods of both the inner and outer, side members to create a rigid beam structure. The resulting beam resists both vertical bending and torsional twisting about its lengthwise axis. The number of pockets 27 will depend upon the length of the beam.

Figure 3:
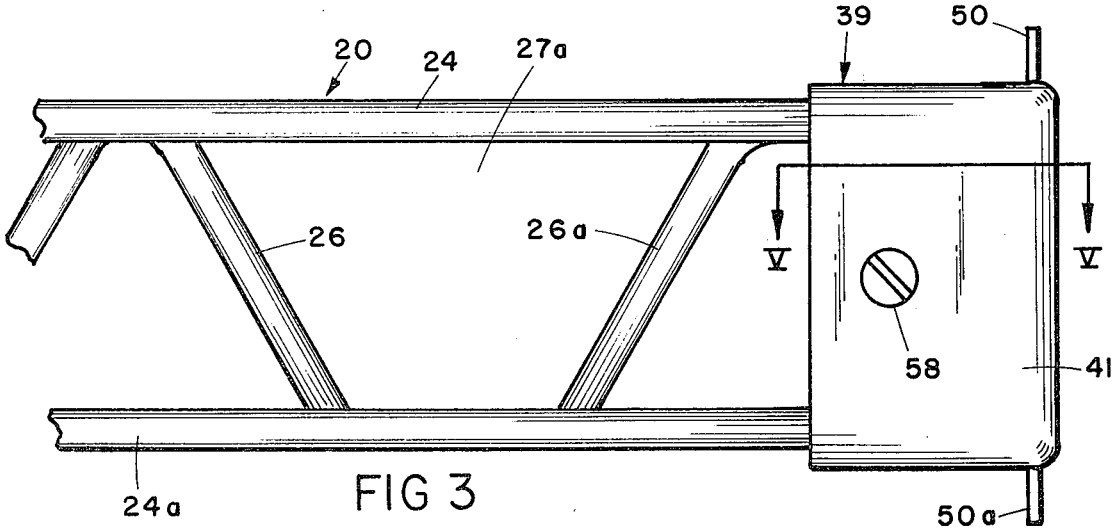
FIG. 3 is an enlarged, fragmentary, front view of the beam with the end bracket attached.
Figure 4:
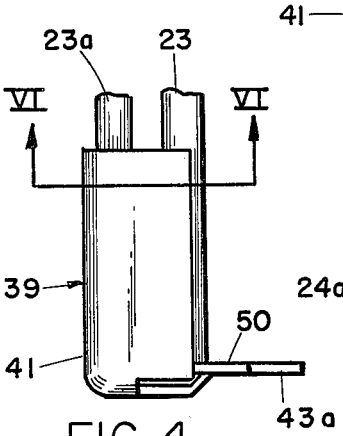
FIG. 4 is a plan view of the end bracket illustrated in FIG. 3.
Figure 6:
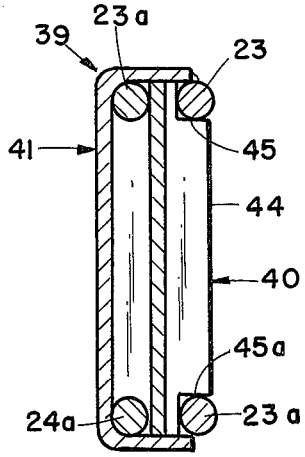
FIG. 6 is a sectional, elevation view taken along the plane VI—VI of FIG. 4.
Figure 5:
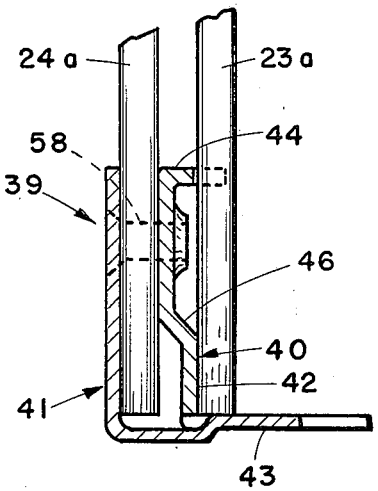
FIG. 5 is a sectional view taken along the plane V—V of FIG. 3.

At each end, a suitable bracket or hanger 39 is secured to the ends of both the inner and outer side members (FIG. 3). Each of the brackets 39 consists of an inner plate 40 and an outer plate 41. These plates are best seen in FIGS. 3 through 8. The inner plate 40 is generally L-shaped having a leg 42 extending lengthwise of the beam and a leg 43 extending at a right angle thereto. The leg 42 at the end opposite from the leg 43 has a flange 44 extending generally parallel to the leg 43. The flange 44 is provided with top and bottom notches 45 and 45*a* to seat the upper and lower rods (FIG. 6). Adjacent the leg 43, the leg 42 has an inwardd offset 46 to provide a seat for the outer face of the rods 23 and 23*a* of the inner, side member 21 (FIG. 5).

Figure 7:
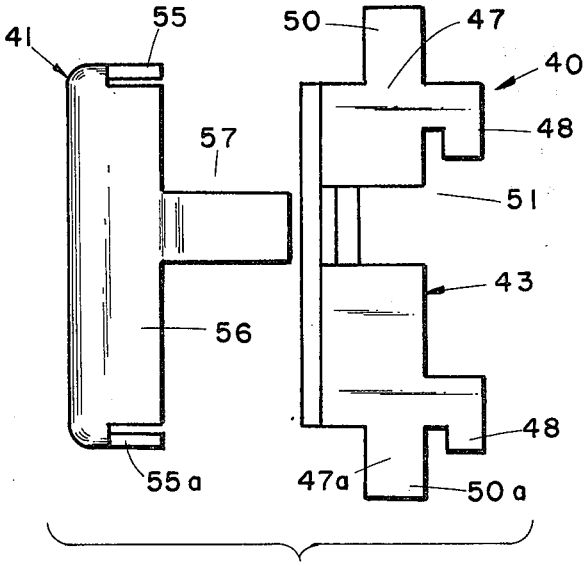
FIG. 7 is an exploded, end view of the end bracket.

The leg 43 has upper and lower portions 47 and 47*a*, each terminating in a hook 48 designed to seat through a slot 49 in a panel standard 12 (FIGS. 7 and 8). Extending upwardly from the upper of the hooks 48 is an ear 50 and extending downwardly from the lower hook 48 is an ear 50*a*. As is illustrated in FIG. 8, the ears seat against the face of the standard 12 and provide stability against vertical rocking of the plate. A horizontal slot 51 separates the upper and lower portions 47 and 47*a*. The hooks 48 are conventional in design. The size, length and shape of the hooks 48 will be governed by the construction of the standard utilized by the manufacturer of the panels. Various types are conventionally available on the market. The spacing between the standards 12 is such that the beam will span the width of one of the panels 11.

The outer plate 41 seats over the outer face of the beam and is provided with upper and lower flanges 55 and 55*a*, which seat around the upper and lower face of the inner and outer side members 21 and 22. A flange 56 seats over the end of the beam and has an inwardly extending finger 57 of a length and width to closely fit within the slot 51 of the inner plate. The inner end of the finger 57 is offset to seat within the plane of the leg 43 of the inner plate 40 (FIG. 5). The plates are secured to each other and clamped about the ends of the beam by the screw 58 (FIGS. 3 and 5). When so assembled, they effectively cap the ends of the beam and provide both a secure support for the beam and give the beam an aesthetically pleasing appearance.

It will be observed from FIGS. 7 and 8 that the tongue 57 is of a length to extend into one of the slots 49 of the standard 12 intermediate those occupied by the hooks 48. Its width is substantially that of the height of the slot. In this construction the inner plates 40 are first mounted on the standards 12 and then the main body of the beam 20 is secured to the inner plates by installation of the outer plates 41. By this arrangement the beam is positively locked to the standards and cannot be inadvertently knocked off or removed. If this locking features is not desired, the tongue 57 and the slot 51 can be omitted without in any way weakening the beam.

It will be recognized that while the preferred construction utilizes a wedge or V-shaped pocket 27, the pocket should be of a different shape. However, the pocket sides should retain a limited degree of downwardly convergent inclination to provide positive seating and control of rocking lengthwise of the beam.

Figure 9:
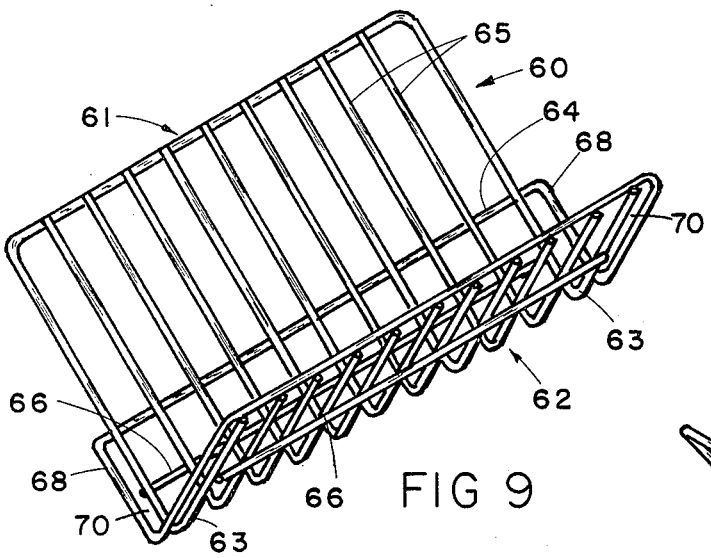
FIG. 9 is an oblique view of one type of rack forming a part of this invention.

While the racks used with this invention can have a wide variety of shapes and configurations, one particular configuration is the rack 60 illustrated in FIG. 9. This particular rack is specifically designed for supporting such items as pamphlets, magazines and similar publications. However, it will be recognized that it can be put to any one of a number of other uses, the particular use being irrelevant to this invention. The rack, in cross section, is generally L-shaped having a large back panel 61 and a smaller base panel 62. The back panel has a primary frame 63 forming the sides and top of the back panel and also forming the side of the base panel 62. The rack 60 also has a loop-shaped secondary frame 64 wider than the primary frame 63 which extends partially up the back panel 61 and forms the end of the base panel. The article supporting surface of the rack is formed by a plurality of parallel wires 65 which are welded to the top of the primary frame 63 and to the secondary frame 64 not only where they intersect the secondary frame in the back panel but also to the secondary frame where it forms the end of the base panel 62. The rack is also further reinforced by additional cross members 66 which are welded to all of the wires 65.

Figure 10:
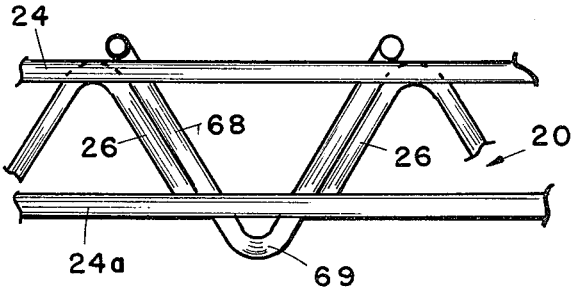
FIG. 10 is a fragmentary, front, sectional view illustrating the typical interrelationship of one of the racks when it is seated in one of the pockets of the beam.

The ends of the secondary frame 64 form downwardly extending hooks or legs 68 of a size and shape to snugly seat within one of the pockets 27 of the beam 20. These legs form the supports for the rack. As is best seen in FIG. 10, the inclination of the sides of the secondary frame forming the hook or leg 68 is such that the sides of the hook seat tightly against the intermediate 26 forming the sides of the pocket with the bottom 69 of the leg 68 extending below the lower edge of the beam 20. The depth of the depending leg is such that positive seating against the sides of the pocket 27 is assured before the horizontal portions of the secondary frame seat on the top of the beam to limit the depth of penetration of the leg into the pocket. For example, the size of the pocket 27 could be such that the bottom of the leg 68 projects from three-fourths to one inch below the bottom of the side members. It is essential to this invention that the bottoms of the legs or hooks of the rack units seat closely between the bottom rods of the side members. It is preferable that the leg or hook extend well beyond this minimum engagement to reduce the possibility of accidental disengagement.

Preferably, the legs 68 are spaced from the side portions of the primary frame 63 such as to form a channel 70 having a width such that the outer sidee member 22 of the beam can slide upwardly in the channel with a minimum of clearance when the rack is mounted on the beam. A rack having the construction previously described can be secured to a beam simply by sliding the leg 68 into one of the pockets 27, the pocket selected being dependent upon the desired location of the rack lengthwise of the beam. Because of the snug interfit with the sides of the pocket, the rack is held against rocking lengthwise of the beam and because of the snug fit of the leg between the side members of the beam and its engagement with both the upper and lower edges of the beam, the rack is stabilized against rocking transversely of the beam even though it is cantilevered from the beam.

Figure 12:
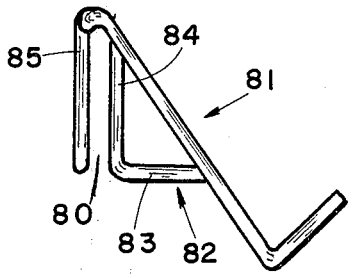
FIG. 12 is an end elevation view of the rack illustrated in FIG. 11.
Figure 11:
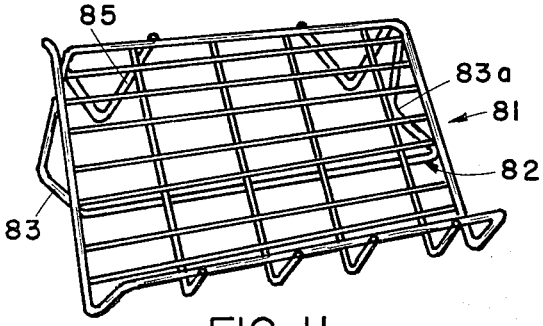
FIG. 11 is an oblique view of a modified rack suitable for use with this invention.

It will be recognized that the interlock between the leg or hook 68 and beam pocket, without additional support or reinforcement is sufficient to support the rack. However, additional support may be provided for units designed for heavy duty or to permit the racks to be fabricated of lighter duty materials. By creating a channel 80 so narrow that it just slidably receives the outer, side member of the beam, reinforcement for the hooks is provided. A rack 81 incorporating such a construction is illustrated in FIGS. 11 and 12. In this construction, the rack is provided with an auxiliary frame 82 which provides a pair of brace portions 83 and 83*a* one at each end of the rack. Each brace has a vertical portion and a horizontal portion. The vertical portion 84 is so located that it seats against the outer face of the beam when the hook 85 is seated in the beam pocket because the channel 80 is just wide enough to slidably receive the rods of the beam's outer, side member.

Figure 13:
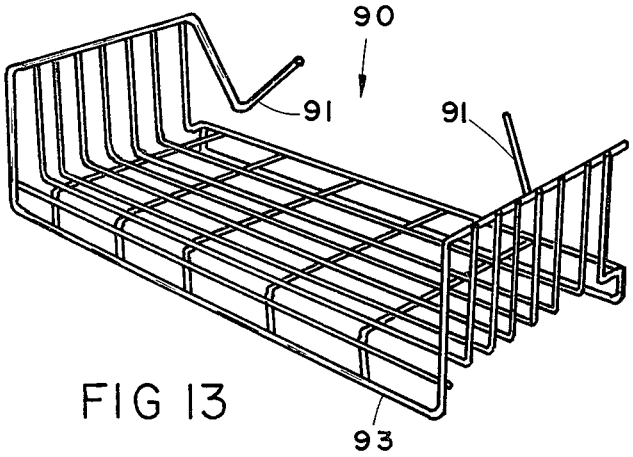
FIG. 13 is an oblique view of a further modified construction for the racks useable with this invention.
Figure 14:
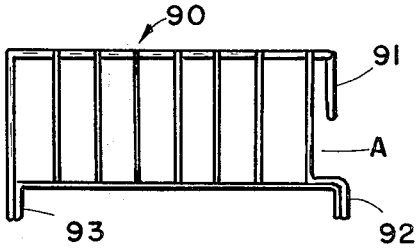
FIG. 14 is an end elevation view of the rack illustrated in FIG. 13.

FIGS. 13 and 14 illustrate a different structure for providing auxiliary support for the racks or trays. In this case, the tray or rack 90, in addition to the hooks 91 has a foot portion 92 at the bottom which extends beneath the beam when the hooks 91 are fully seated in the beam pockets. The length of the foot portion 92 is such that it bears against the panel surface and positively holds the tray or rack against downward bending about the tops of the hooks. This is particularly suitable where heavy loads, such as book storage, are anticipated Also, the addition of downwardly extending lips 93 and 93*a* at the front and back of the tray reinforce the tray against lengthwise bending. In this construction, the spacing A between the end of the hooks and the foot portion 92 must at least equal and preferably exceed the height of the beam 20 to permit the hooks 91 to be aligned with the beam pockets 27.

Figure 15:
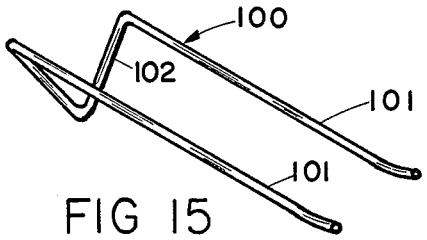
FIG. 15 is an oblique view of a shelf support incorporating this invention.
Figure 16:
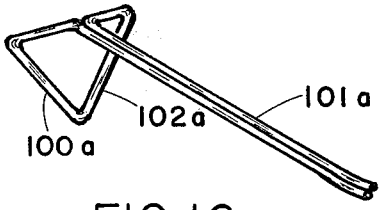
FIG. 16 is an oblique view of a modification of the shelf support illustrated in FIG. 15.

FIGS. 15 and 16 illustrate the versatility of the invention. These figures show two different forms of a rack structure which can be used either to hang articles or to support a platform such as a shelf. In the case of the rack 100, the support arms 101 are spaced apart and in the case of the rack 100*a*, the arms 101*a* abut each other and preferably are welded together. In both cases, the rack has a hook or leg 102 of a size and shape to snugly seat into one of the pockets 27 of a beam 20. The fact that the hook 102*a* of the rack 100*a* is closed does not change its functional characteristics.

Figure 17:
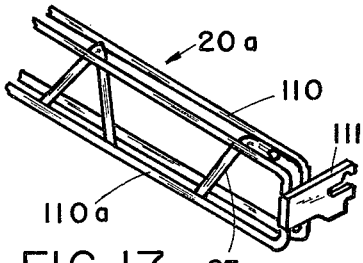
FIG. 17 illustrates a modified construction for the beam and its supporting brackets.

FIG. 17 illustrates a modified beam construction in which the inner and outer sides of the beam 20*a* are closed loops 110 and 110*a* formed from the same stock as the rods previously described. Also, the end caps are replaced by a simple hanger bracket 111 having hooks to engage the panel standards. The brackets 111 are welded to the ends of the side member loops.

It will be obvious from the preceding description that a particularly simple yet effective mount or support for accessories is provided by this invention. It is also obvious that the ease with which the accessories can be relocated along the beam or from beam to beam is also particularly advantageous. Further, the beam as well as the racks can be moved from panel to panel or shifted vertically to meet the needs of the user. The provision of a hook at both ends of a rack such as is provided by rack 61 is not essential to practice of the invention but it is desirable. It permits the rack to be reversed end-for-end to meet the requirements of the user. Thus, the need for separate left and right models is eliminated.

Whether the invention is incorporated as part of an L-shaped rack, a tray or a flat storage platform or the like is irrelevant because the invention can be applied to all such structures once the principles of construction, as explained in the preceding paragraphs, have been incorporated into the product. Thus, the invention has a wide range of application while permitting rapid relocation and adjustment of the various accessories to satisfy a wide variety of uses and operating circumstances. The fact that the invention has been described in connection with a limited number of types of accessories is not to be considered as limiting the invention only to accessories of the type illustrated.

Having described a preferred construction and various modifications of the preferred constructions, it will be recognized that other modifications can be made without departing from the principles of the invention. Such modifications are to be considered as included in the hereinafter appended claims unless these claims by their language expressly state otherwise.

The embodiments of the invention in which an exclusive property or privilege is claimed are defined as follows:

1. An article support for use with a modular panel space divider system having support means along the vertical edges of each panel for detachably mounting accessory members, said article support including a rigid beam of a length to extend between said support means and having anchor means at each of its ends for detachably securing it to said support means in spaced and parallel relationship to the surface of a panel, said beam characterized by a pair of rigid elongated upper elements and a pair of rigid elongated lower elements, intermediate elements rigidly secured to and between said upper elements and between said lower elements and vertically spacing said upper elements from said lower elements, said intermediate elements forming a plurality of vertical pockets between said upper and lower elements opening through both the top and bottom of said beam, said pockets being arranged in tandem along said beam for receiving the complementary-shaped hooks of an article supporting rack.

2. An article support as described in claim 1 wherein the end walls of each of said pockets are downwardly and convergently inclined.

3. An article support as described in either claim 1 or 2 wherein each of said elongated elements is a rod; said intermediate elements being rod segments seated between the rods of said upper and lower elongated elements and securely welded thereto for forming said pockets.

4. An article support as described in claim 1 wherein each of said anchor means has an inner plate and an outer plate; said inner plate having a leg member engaging said support means; said inner plate being seated laterally between said elongated elements, said outer plate seating over the outer face of said beam and being secured to said inner plate.

5. An article support as described in claim 1 wherein each of said anchor means has a pair of plates, one seated laterally between said elongated elements and the other seated against the outer face of said beam, means securing said plates together with the outer ones of said upper and lower elongated elements clamped therebetween.

6. An article support as described in claim 1 wherein said one plate has a flange terminating in fingers for engaging and locking to said support means and said other plate has a tongue extending in the same direction and in the same vertical plane as said flange, said tongue having a length to penetrate the support means when the beam is secured thereto.

7. An article support as described in claim 6 wherein said flange is bifurcated by a slot, said tongue being received in said slot.

8. An accessory supporting beam for movable panel walls wherein each panel has an accessory mounting strip adjacent each of its vertical edges, said beam comprising: a pair of spaced, elongated side members having vertically spaced upper and lower edges, intermediate means seated between said side members and rigidly secured to both said side members, said intermediate means having inclined portions forming a plurality of generally V-shaped pockets, the slope and spacing of the inclined portions being such that the apices of the pockets are below the lower edge of the sides; hanger means at each end of said sides for detachably securing said beam to said mounting strips.

9. An accessory supporting beam as described in claim 8 wherein each of said sides has a pair of parallel rods, one forming each of said upper and lower edges; said intermediate means being rod segments, said rods and rod segments being welded together.

10. An accessory supporting beam as described in either claim 8 or 9 wherein each of said hanger means includes a pair of plates one seated between said sides of said beam and the other seated against the outer side of said beam, means securing said plates together with the outer one of sides clamped therebetween.

11. An accessory supporting beam for movable panel walls as described in claim 8 wherein said hanger means includes vertically spaced fingers for hooking to said mounting strip; said hanger means having a tongue between said fingers of a length to penetrate the mounting strip for preventing vertical movement of said beam relative to the mounting strip.

12. An accessory supporting beam for movable panel walls as described in claim 8 wherein each of said hanger means includes a pair of plates one seated between said sides of said beam and the other seated against the outer side of said beam, means securing said plates together with the outer one of said sides clamped therebetween; one of said plates having a locking tongue projecting therefrom in a direction normal to the plane of said beam and of a length to penetrate said mounting strips.

13. An article beam having a support beam and a rack, said beam having elongated inner and outer members having spaced upper and lower edges; rigid intermediate means between said inner and outer members, said inner and outer members being seated against said intermediate means and rigidly secured thereto; said intermediate means being shaped to form a plurality of wedge-shaped pockets arranged in tandem lengthwise of said beam and opening through the top of said beam; means for mounting said beam to a vertical panel; said rack having an article supporting portion and a hook portion at one end, said hook portion also being wedge-shaped and of a size and shape to slidably and snugly fit within one of said pockets with the sides of the hook seated against and engaging the end walls of the pockets and the end of the hook extending at least to the bottom of the support; said hook portion detachably supporting said rack from said beam in cantilever fashion when said hook portion is seated in one of said pockets.

14. An article beam as described in claim 13 wherein said rack has means for engaging and bearing against the outside face of said beam to provide auxiliary support for said rack.

* * * * *